United States Patent [19]

Brenner

[11] 4,270,830

[45] Jun. 2, 1981

[54] WIRE CONNECTOR

[75] Inventor: Stanley Brenner, Massapequa, N.Y.

[73] Assignee: Perfect-Line Manufacturing Corp., Lindenhurst, N.Y.

[21] Appl. No.: 111,289

[22] Filed: Jan. 11, 1980

[51] Int. Cl.[3] ..... H01R 11/20; E04G 7/08

[52] U.S. Cl. ..... 339/99 R; 339/249 B; 403/393; 403/398

[58] Field of Search ..... 339/97 R, 99 R, 95 R, 339/98, 96, 97 P, 97 T, 244 B, 249 B, 272 B; 403/393, 398, 399

[56] References Cited

U.S. PATENT DOCUMENTS

| | | | |
|---|---|---|---|
| 2,450,158 | 9/1948 | Pennell | 339/244 B |
| 2,547,225 | 4/1951 | Mebold | 403/398 X |
| 4,080,034 | 3/1978 | Werner | 339/98 |

FOREIGN PATENT DOCUMENTS

| | | | |
|---|---|---|---|
| 270362 | 11/1950 | Switzerland | 339/272 B |
| 391560 | 5/1933 | United Kingdom | 339/272 B |
| 839254 | 6/1960 | United Kingdom | 339/272 B |

*Primary Examiner*—John McQuade
*Assistant Examiner*—John S. Brown
*Attorney, Agent, or Firm*—James P. Mulone

[57] ABSTRACT

A wire connector. A body member has a lower hollow internally threaded portion and an upper portion with a slot in the lower portion. A pair of spaced electrodes are mounted in the upper portion, the lower ends of said electrodes being pointed and extending into the area of the slot. A ring member has a central portion bridging the ring, and the ring member is slidably mounted on the lower portion of the body member. An externally threaded member is threadedly connected to the internally threaded hollow portion of said body member. Whereby an insulated two conductor cable may be inserted through said slot between the lower ends of the electrodes and the ring member and the externally threaded member may be screwed into the body member to force the electrode points through the insulation of the cable and causing each electrode point into contact with one of the conductors of said cable.

1 Claim, 3 Drawing Figures

WIRE CONNECTOR

TECHNICAL FIELD

This invention relates to wire connectors and more particularly for lighting or other fixtures.

BACKGROUND ART

In some cases it is desired to connect a string of lights for instance, on top of a fence or around a patio. The use of conventional connectors for this purpose requires a number of connections including connection boxes and involves cutting and striping the connecting wires and making the connections at the location of each light.

DISCLOSURE OF THE INVENTION

The present invention provides a simple inexpensive means for making such connections without any cutting, stripping and connecting wires at each location.

In the present invention, the connector fits over a continuous two conductor wire cable and the connections are made by forcing pointed electrodes through the insulation and into contact with the two conductor wires.

Accordingly, a principal object of the invention is to provide a new and improved wire connecting means.

Another object of the invention is to provide a new and improved wire connector which eliminate the necessity for cutting, stripping and making wire connections at different locations.

Another object of the invention is to provide new and improved wire connectors which eliminate the necessity for cutting, stripping and making wire connections at different locations wherein in pointed electrodes are forced into contact with continuous two conductor wire cables.

Another object of the invention is to provide new and improved wire connectors comprising a body member having a lower hollow internally threaded portion and an upper portion, a slot in said lower portion, a pair of spaced electrodes mounted in said upper portion, the lower ends of said electrodes being pointed and extending into the area of said slot, a ring member having a central portion bridging the ring, said ring member being slidably mounted on the lower portion of said body member, an externally threaded member threadedly connected to the internally threaded hollow portion of said body member, whereby an insulated two conductor cable may be inserted through said slot between the lower ends of said electrodes and said ring member and the externally threaded member may be screwed into the body member to force the electrode points through the insulation of said cable and causing each electrode point into contact with one of the conductors of said cable.

These and other objects of the invention will be apparent from the following specifications and drawings of which:

BEST MODE FOR CARRYING OUT THE INVENTION

Figure 2:
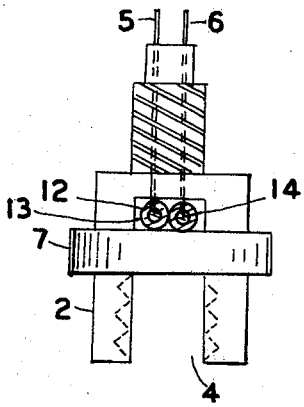
FIG. 2 is a side view of a portion of the embodiment of FIG. 1.
Figure 3:
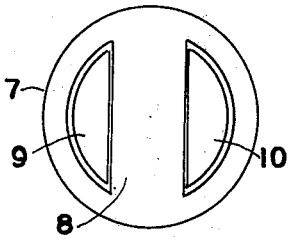
FIG. 3 is a bottom view of FIG. 2.

Referring to the drawings, the wire connector of the present invention, comprises a body member 1, having a lower internally threaded portion 2, and an upper portion 3. As shown in FIG. 2, the lower portion 2 has a slot 4. A pair of spaced electrodes 5 and 6 are mounted in the upper portion 3 of the body member 1, and insulated from each other. The electrodes have points 5' at their lower ends. A ring member 7 has a central portion 8, bridging the ring and a pair of apertures 9 and 10, which fit over the lower portion 2 on the body member 1, and is slidably mounted on the body member 1. A member 11 having external threads 11' is adapted to be screwed into the internal threads of the lower portion of the body member.

When it is desired to make a connection on a continuous two wire cable 12, the upper portion is fitted over the cable 12, the ring member 7 is slipped underneath and the externally threaded member 11 is screwed into the lower portion 2 of the body member. The cable 12 has two conductors, 13 and 14, each of which is covered with its own insulating cover in conventional manner. As the member 11 is tightened the bridged ring member squeezes the cable 12 against the pointed lower ends of the electrodes 5 and 6 causing the points of the electrodes to pass through the insulation of the cables so that one electrode comes in contact with wire 13 and one electrode comes in contact with wire 14.

Figure 1:
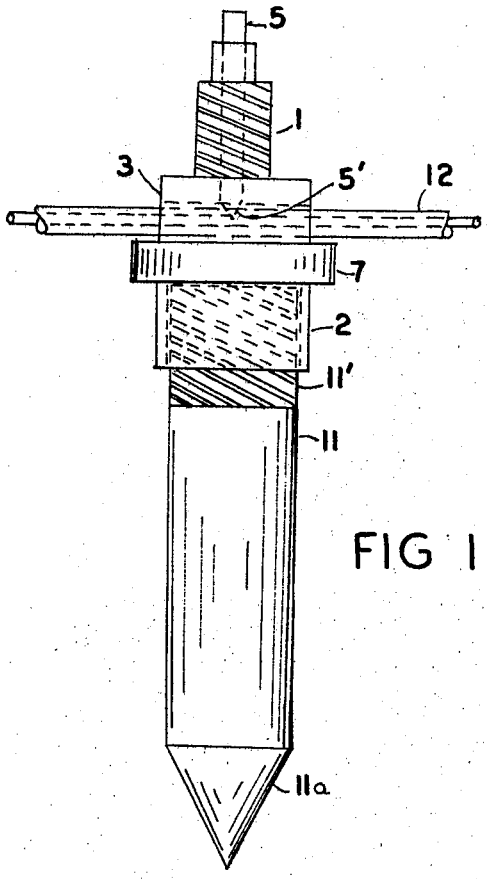
FIG. 1 is a front view of an embodiment of the invention.

In FIG. 1, the member 11 is shown with the pointed lower end **11*a* so that the member 11 may be inserted into the ground. This stake would be suitable for mounting in the ground, for instance, around a patio or lawn. However, the member 11** could also have other mounting means for mounting it on fence posts, etc. The upper end of the body member may be conventional mounting or connection for lights, lamps or other fixtures.

It is claimed

1. A wire connector comprising:

a body member having a lower hollow internally threaded portion and an upper portion, a slot in said lower portion, a pair of spaced electrodes mounted in said upper portion, the lower ends of said electrodes being pointed and extending into the area of said slot, a ring member having a central portion bridging the ring member, said ring member being slidably mounted on the lower portion of said body member, an externally threaded member threadedly connected to the internally threaded hollow portion of said body member, whereby an insulated two conductor cable may be inserted through said slot between the lower ends of said electrodes and said ring member and the externally threaded member may be screwed into the body member to force the electrode points through the insulation of said cable and causing each electrode point into contact with one of the conductors of said cable.

* * * * *